US010581192B2

(12) United States Patent
Takahashi et al.

(10) Patent No.: US 10,581,192 B2
(45) Date of Patent: Mar. 3, 2020

(54) CONNECTOR

(71) Applicant: Sumitomo Wiring Systems, Ltd., Yokkaichi, Mie (JP)

(72) Inventors: Kenya Takahashi, Mie (JP); Daisuke Ito, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/090,717

(22) PCT Filed: Mar. 29, 2017

(86) PCT No.: PCT/JP2017/012828
§ 371 (c)(1),
(2) Date: Oct. 2, 2018

(87) PCT Pub. No.: WO2017/179424
PCT Pub. Date: Oct. 19, 2017

(65) Prior Publication Data

US 2019/0123475 A1 Apr. 25, 2019

(30) Foreign Application Priority Data

Apr. 11, 2016 (JP) ..... 2016-078699

(51) Int. Cl.
*H01R 13/506* (2006.01)
*H01R 13/42* (2006.01)
(Continued)

(52) U.S. Cl.
CPC ..... *H01R 13/506* (2013.01); *H01R 13/42* (2013.01); *H01R 13/5213* (2013.01); *H01R 13/582* (2013.01)

(58) Field of Classification Search
CPC .... H01R 12/75; H01R 13/502; H01R 13/516; H01R 13/6271; H01R 13/6272; H01R 13/6275
(Continued)

(56) References Cited

U.S. PATENT DOCUMENTS 5,947,762 A * 9/1999 Katsuma ..... H01R 13/5202 439/157
6,174,193 B1 * 1/2001 Nagano ..... H01R 13/506 439/468
(Continued)

FOREIGN PATENT DOCUMENTS

JP 3-57175 3/1991
JP 7-153521 6/1995
(Continued)

OTHER PUBLICATIONS

International Search Report dated Jun. 13, 2017.

*Primary Examiner* — Hien D Vu
(74) *Attorney, Agent, or Firm* — Gerald E. Hespos; Michael J. Porco; Matthew T. Hespos

(57) ABSTRACT

A connector 10 disclosed by this specification includes a housing (retainer 30), and a cover 50 to be attached to the housing from behind. The cover 50 includes an opening 57 open in a direction intersecting an attaching direction to the housing, a facing portion 58 facing the opening 57, an outer lock portion 55 provided at least on the facing portion 58 and an inner lock portion 54 provided adjacent to the outer lock portion 55. The housing includes an outer lock receiving portion 36 to be locked in a separating direction of the cover 50 by the outer lock portion 55 coming into contact therewith from an outer peripheral side and an inner lock portion 35 to be locked in the separating direction of the cover 50 by the inner lock portion 54 coming into contact therewith from an inner peripheral side.

5 Claims, 10 Drawing Sheets

(51) Int. Cl.
*H01R 13/52* (2006.01)
*H01R 13/58* (2006.01)

(58) Field of Classification Search
USPC ..... 439/357, 358, 465, 468
See application file for complete search history.

(56) References Cited

U.S. PATENT DOCUMENTS

| | | | | |
|---|---|---|---|---|
| 7,267,564 | B2 * | 9/2007 | Bauman | H01R 13/62955 439/157 |
| 7,364,472 | B2 * | 4/2008 | Kameyama | H01R 13/5219 439/271 |
| 7,476,121 | B2 * | 1/2009 | Tsuji | H01R 13/4223 439/465 |
| 10,236,618 | B1 * | 3/2019 | Irish | H01R 13/516 |
| 2009/0061672 | A1 | 3/2009 | Nagano et al. | |
| 2013/0017714 | A1 | 1/2013 | Kao et al. | |
| 2015/0303614 | A1 | 10/2015 | Kurita | |

FOREIGN PATENT DOCUMENTS

| | | |
|---|---|---|
| JP | 11-185869 | 7/1999 |
| JP | 2007-87681 | 4/2007 |
| JP | 2009-64571 | 3/2009 |
| JP | 2015-216090 | 12/2015 |

* cited by examiner

CONNECTOR

BACKGROUND

Field of the Invention

This specification relates to a connector.

Related Art

Japanese Unexamined Patent Publication No. 2009-64571 discloses a cover attachment structure capable of preventing the detachment of a cover from a housing. In this structure, a projection provided on a main wall of a housing is fit into a locking groove provided in a main outer wall of a cover lock. Thus, the main outer wall of the cover lock is locked to the main wall of the housing from an outer surface side. Further, a locking projection provided on a main inner wall of a cover body integrally covers lock and is fit into a lock hole in a main peripheral wall of the housing. Thus, the main inner wall is locked from an inner peripheral side to the main peripheral wall constituting a locked wall together with the main wall.

According to this connector, locking by the main inner wall and the main outer wall is not released unless both forces for moving the main inner wall inwardly of the housing and moving the main outer wall outwardly of the housing act on a wire cover. Thus, even if a load is applied in one direction perpendicular to principal surfaces of the housing and the cover body, the cover body is not removed from the housing due to the release of locking by the main inner wall and the main outer wall unless a load also is applied in a direction opposite to the one direction. Thus, the removal of the cover body from the housing can be made difficult. As a result, the detachment of the wire cover from the housing can be prevented.

However, in the above cover attachment structure, if wires are pulled vertically, i.e. if the wires are pulled in a direction orthogonal to the direction perpendicular to the principal surfaces of the housing and the cover body, the projection is disengaged from the locking groove, and the locking projection is disengaged from the lock hole so that the cover may be separated and detached from the housing.

SUMMARY

A connector disclosed by this specification includes a housing, and a cover to be attached to the housing from behind. The cover includes an opening open in a direction intersecting an attaching direction to the housing, a facing portion facing the opening, an outer lock provided at least on the facing portion and an inner lock portion provided adjacent to the outer lock. The housing includes an outer lock receiving portion to be locked in a separating direction of the cover by the outer lock coming into contact therewith from an outer peripheral side and an inner lock to be locked in the separating direction of the cover by the inner lock coming into contact therewith from an inner peripheral side.

According to this configuration, even if the inner lock moves away from the inner lock receiving portion to release a locked state when the opening of the cover is pulled rearward, the outer lock conversely approaches the outer lock receiving portion to maintain the locked state. Thus, the facing portion of the cover is not separated from the housing. Further, even if the outer lock moves away from the outer lock receiving portion to release the locked state when the opening of the cover is pushed forward, the inner lock approaches the inner lock receiving portion to maintain the locked state. Thus, the facing portion of the cover is not separated from the housing.

The cover may include a fitting tube configured into a tubular shape by alternately disposing a plurality of the outer lock portions and a plurality of the inner lock portions side by side. According to this configuration, the fitting tube can be reduced in size as compared to the case where the outer locks and the inner locks are disposed in an overlapping manner.

The outer locks may be disposed at equal intervals over an entire circumference of the fitting tube. Accordingly to this configuration, the locked state is maintained even if the cover is pulled in any direction. Thus, the cover is not separated from the housing.

According to the connector disclosed by this specification, the separation of the facing portion of the cover from the housing can be prevented when the opening of the cover is pulled rearward.

DETAILED DESCRIPTION

Figure 1:
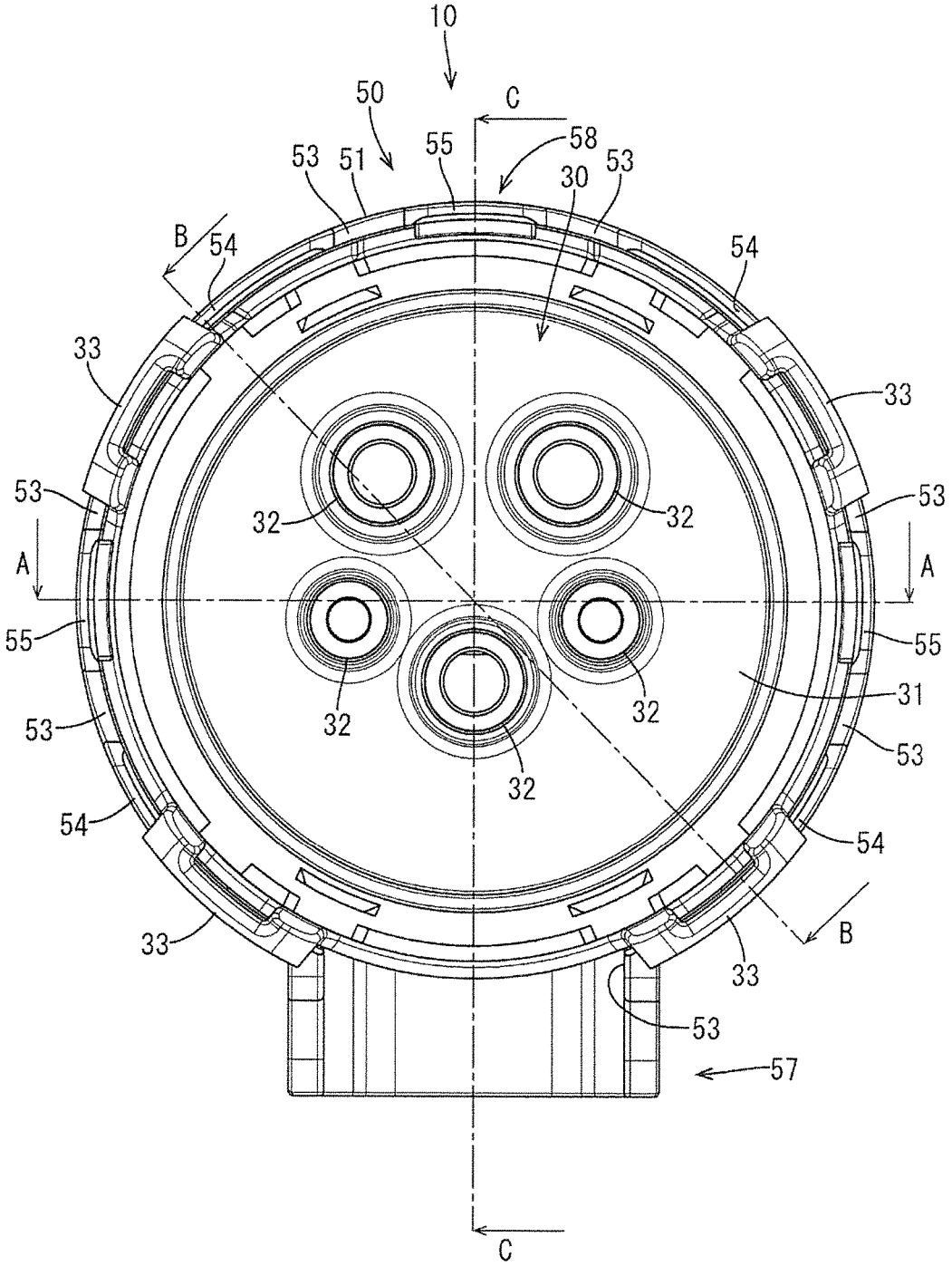
FIG. 1 is a front view of a connector.
Figure 2:
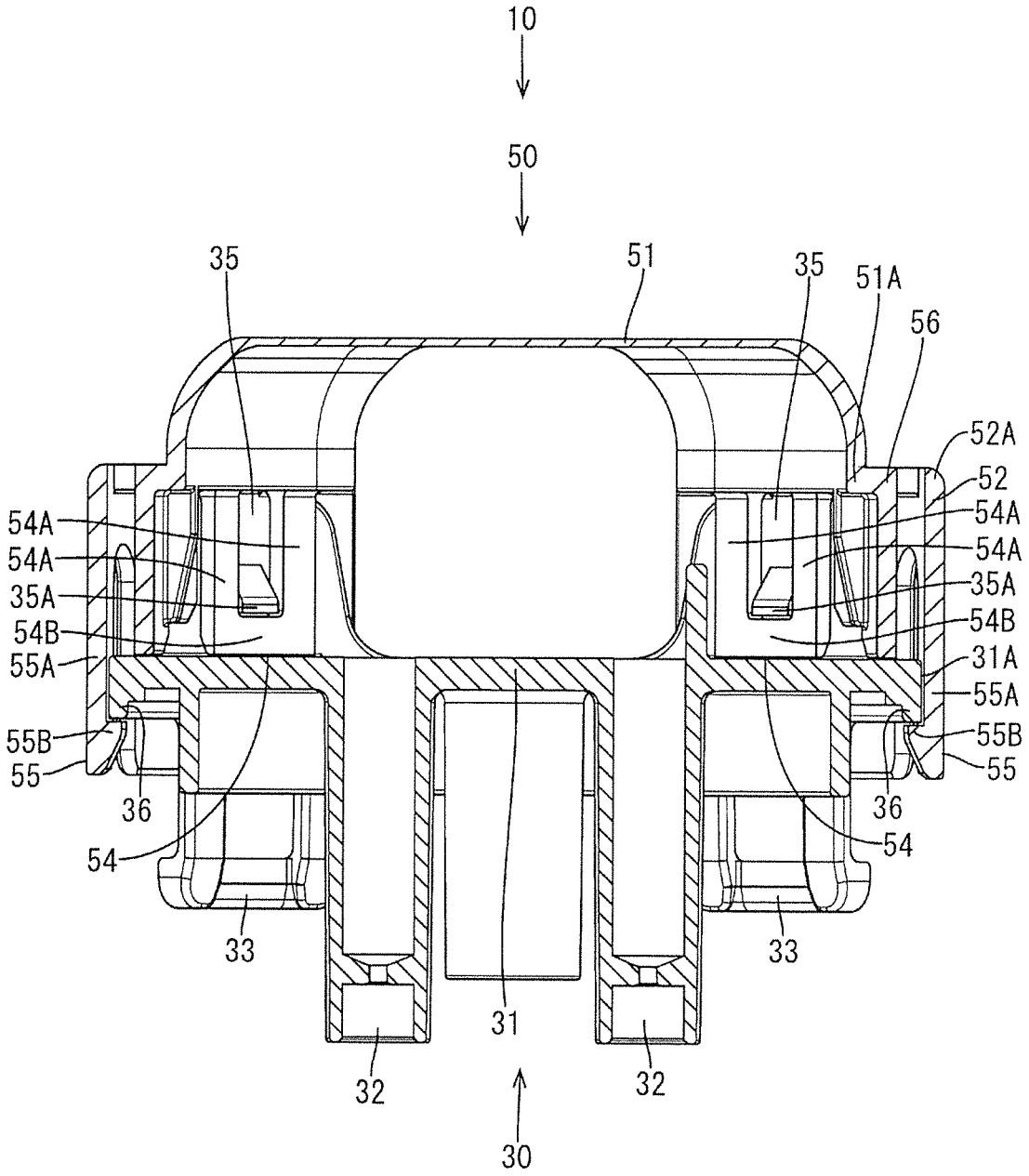
FIG. 2 is a section along A-A in FIG. 1.
Figure 3:
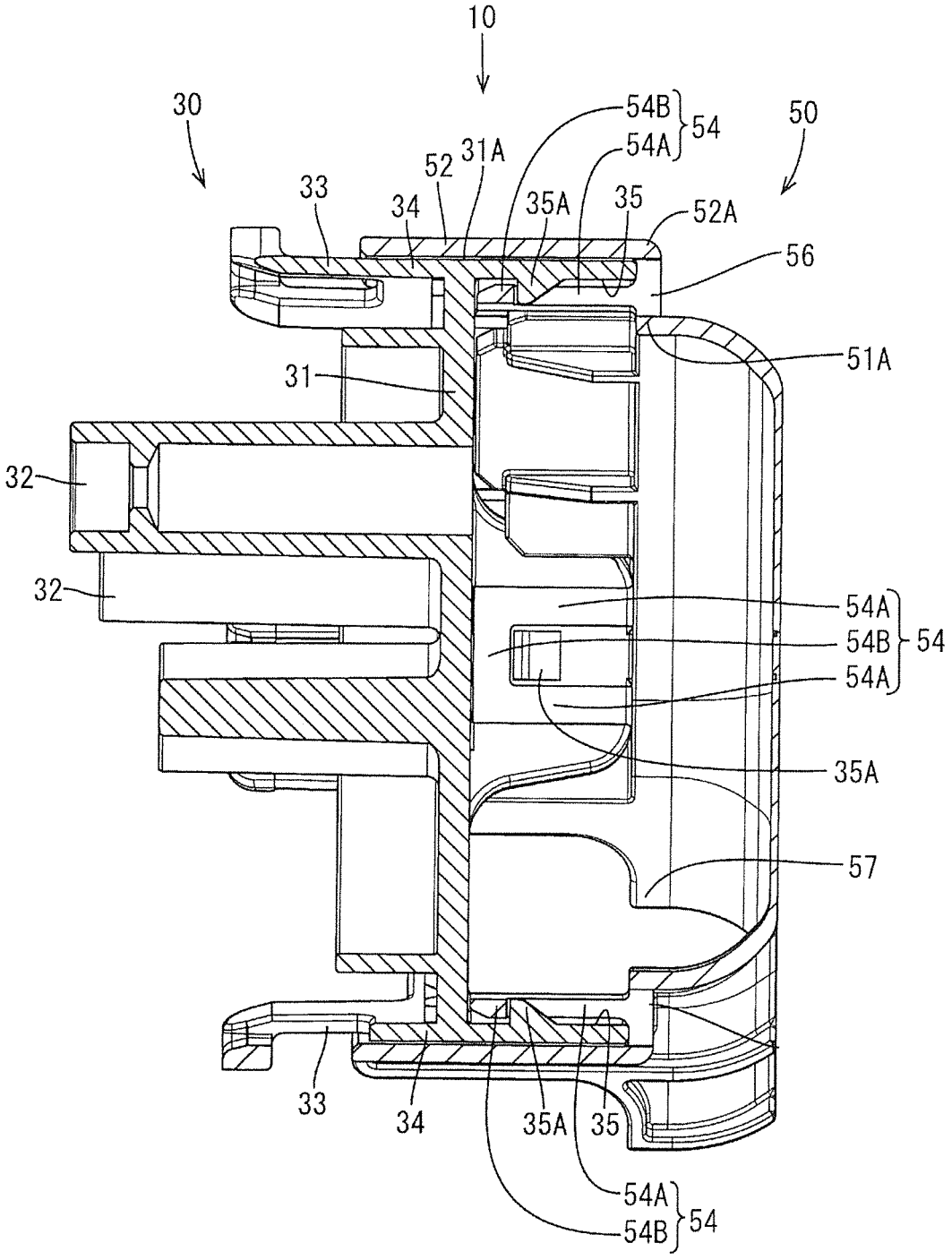
FIG. 3 is a section along B-B in FIG. 1.

An embodiment is described with reference to FIGS. 1 to 10. As shown in FIG. 3, a connector 10 of this embodiment includes a retainer 30 and a cover 50. The retainer 30 is configured to retain unillustrated terminals from behind by being attached to an unillustrated inlet body from behind. The cover 50 is configured to protect unillustrated wires pulled out from the inlet body. The retainer 30 is attached to the inlet body from behind, and the cover 50 is attached to the retainer 30 from behind. The terminals, such as power terminals and signal terminals, are accommodated in the inlet body, and wires connected to these terminals are pulled out rearward from the inlet body.

Figure 5:
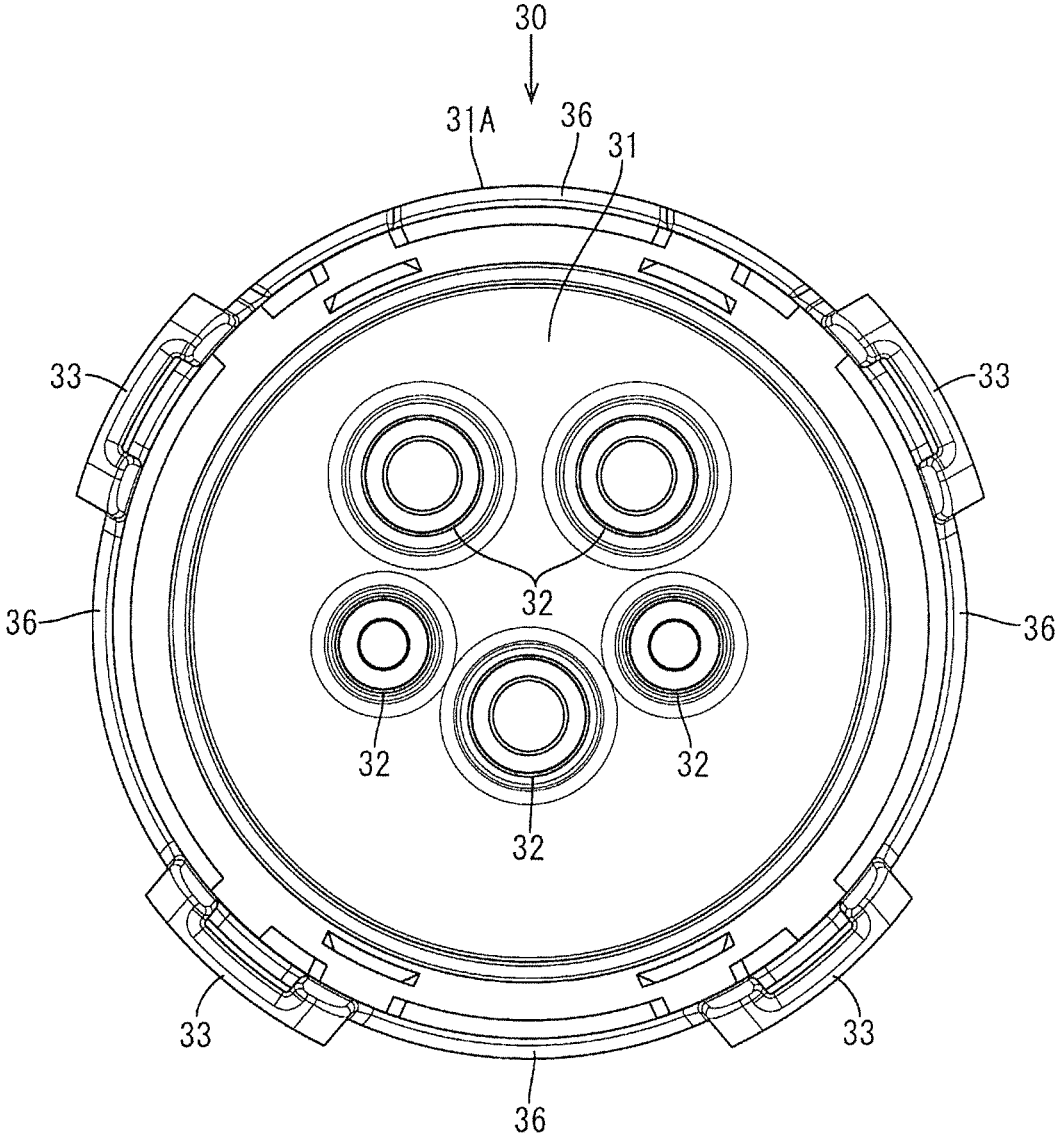
FIG. 5 is a front view of a retainer.
Figure 6:
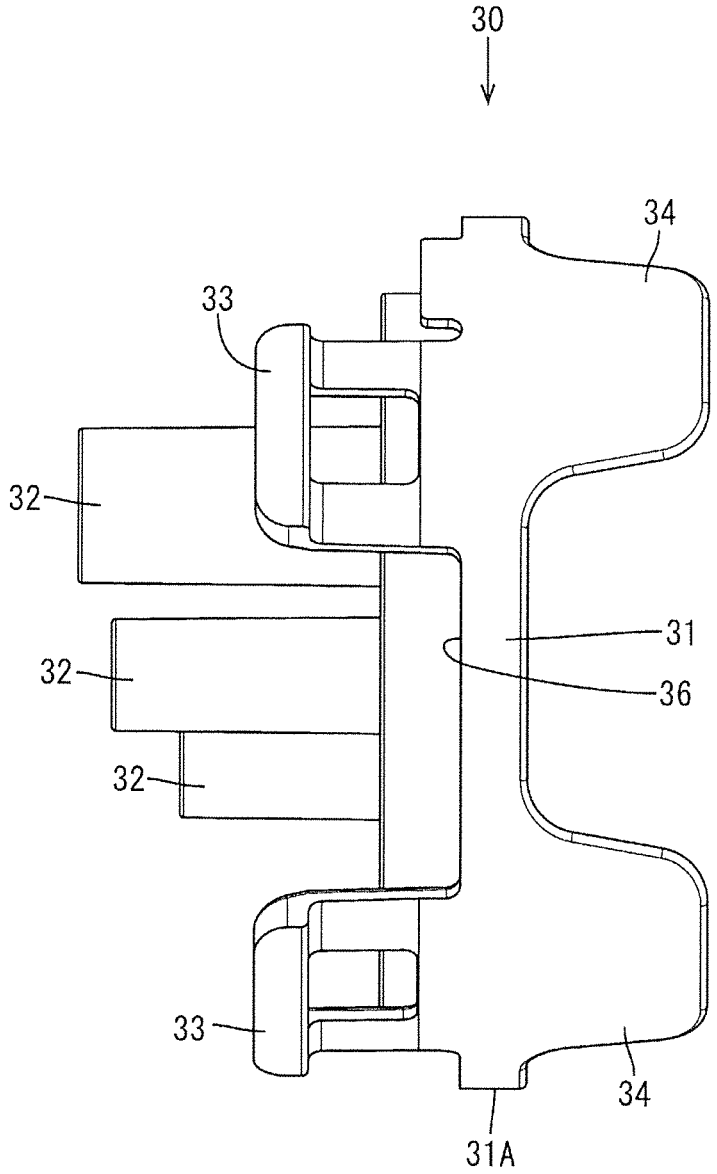
FIG. 6 is a side view of the retainer.
Figure 7:
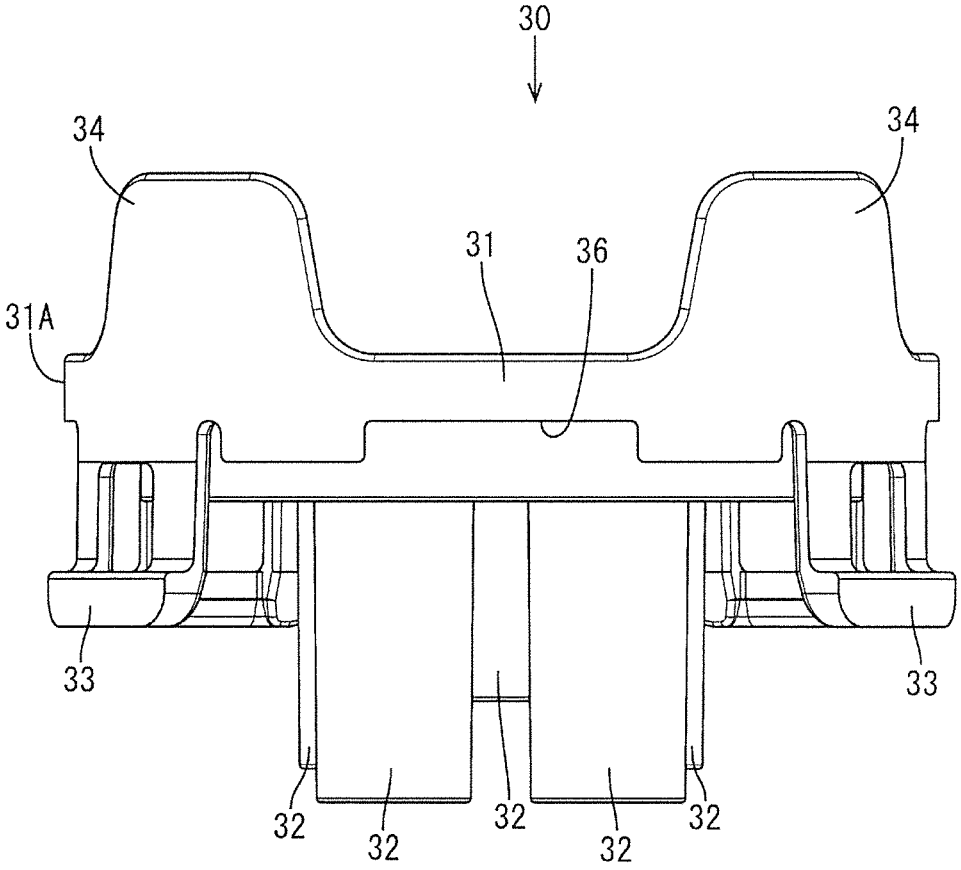
FIG. 7 is a plan view of the retainer.

The retainer 30 is made of synthetic resin and includes, as shown in FIGS. 5 to 7, a circular base plate 31, and terminal holding portions 32 penetrate through the base plate 31 in a plate thickness direction. Retainer mounting pieces 33 project forward from the peripheral edge of the base plate 31 and cover attaching portions 34 project rearward from the peripheral edge of the base plate 31. The retainer mounting pieces 33 and the cover attaching portions 34 are extend arcuately along an outer peripheral surface 31A of the base plate 31.

The terminal holding portion 32 has a hollow cylindrical shape and can contact a flange on the outer periphery of the terminal from behind. In this way, each terminal is held not to come out by each terminal holding portion 32 while being accommodated in the inlet body. The retainer mounting pieces 33 ride on the projections when the retainer 30 is attached to the inlet body from behind. However, the retainer mounting pieces 33 are resiliently deflectable, and resiliently return to lock projections on the inlet body at a proper attaching position to hold the retainer 30 on the inlet body.

As shown in FIG. 6, the cover attaching portions 34 extend rearward while being flush with the outer peripheral surface 31A of the base plate 31. Specifically, the cover attaching portions 34 extend in a circumferential direction while having an arcuate shape when viewed from behind. Further, the cover attaching portions 34 are at positions substantially corresponding to the respective retainer mounting pieces 33 in a front-rear direction. As shown in FIG. 3, the inner peripheral surfaces of the cover attaching portions 34 serve as inner lock receiving portions 35, and locking projections 35A are provided on the inner lock receiving portions 35 to project radially inward.

Figure 8:
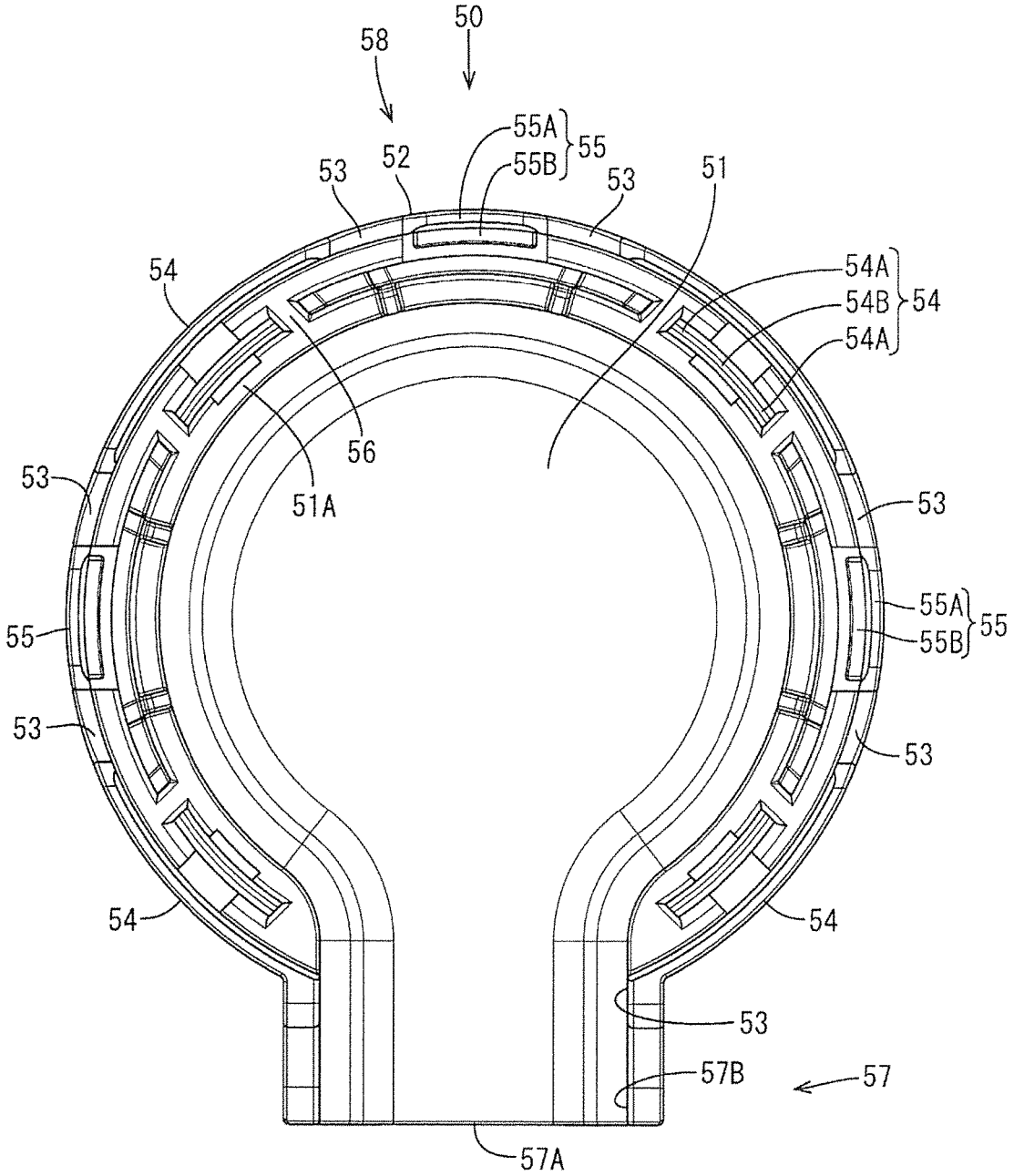
FIG. 8 is a front view of a cover.
Figure 9:
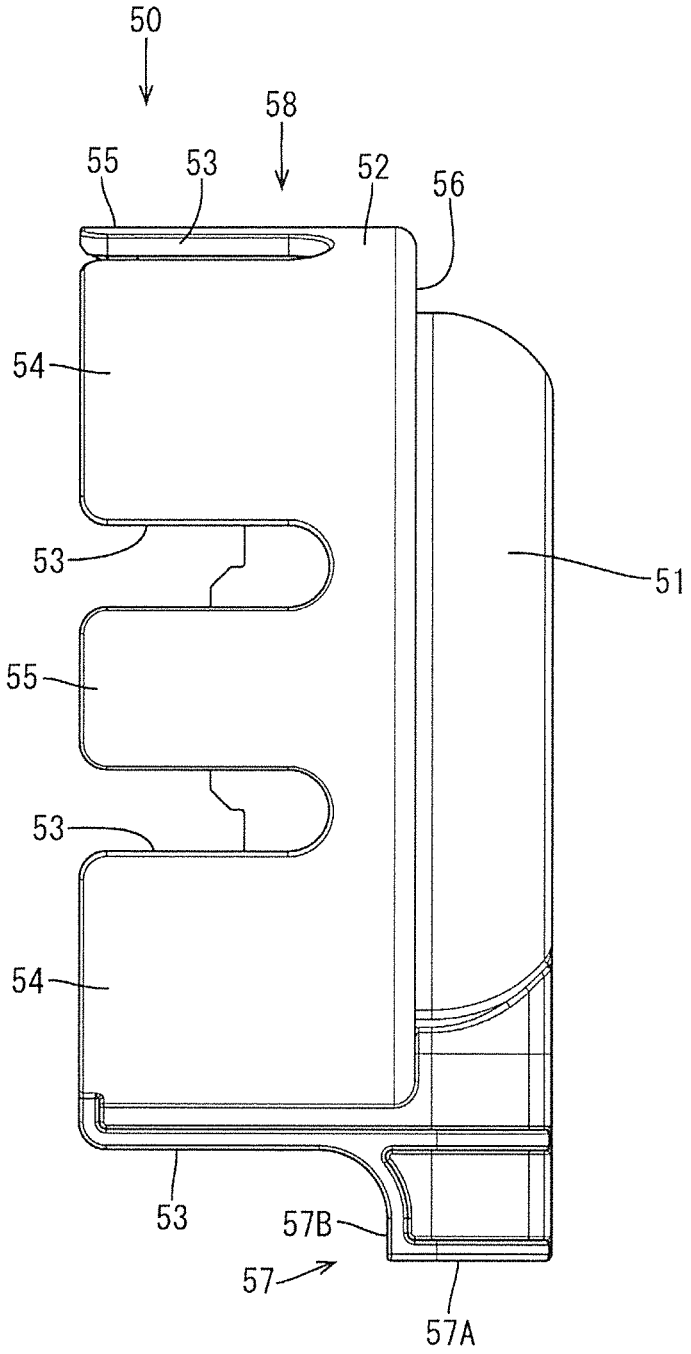
FIG. 9 is a side view of the cover.
Figure 10:
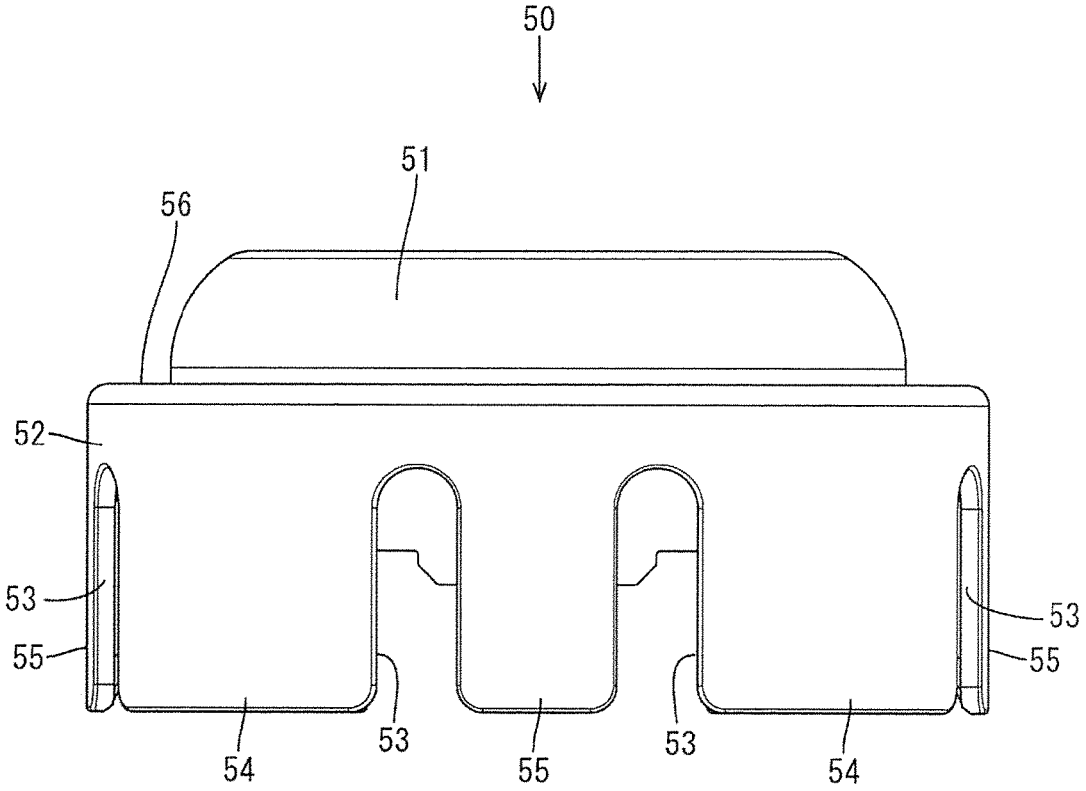
FIG. 10 is a plan view of the cover.

The cover 50 is made of synthetic resin and includes, as shown in FIGS. 8 to 10, a cover body 51 configured to cover wires along a wire routing path and a fitting tube 52 to be fit externally on the cover attaching portions 34 of the retainer 30. The fitting tube 52 is provided with cutouts 53 that divide the fitting tube portion 52 into relatively wide inner locks 54 and relatively narrow outers 55. The inner and outer locks 54, 55 are disposed alternately side by side in the circumferential direction. The inner locks 54 are locked to the inner lock receiving portions 35 described above. Further, the cover attaching portions 34 of the retainer 30 are covered and protected by the inner lock portions 54.

Figure 4:
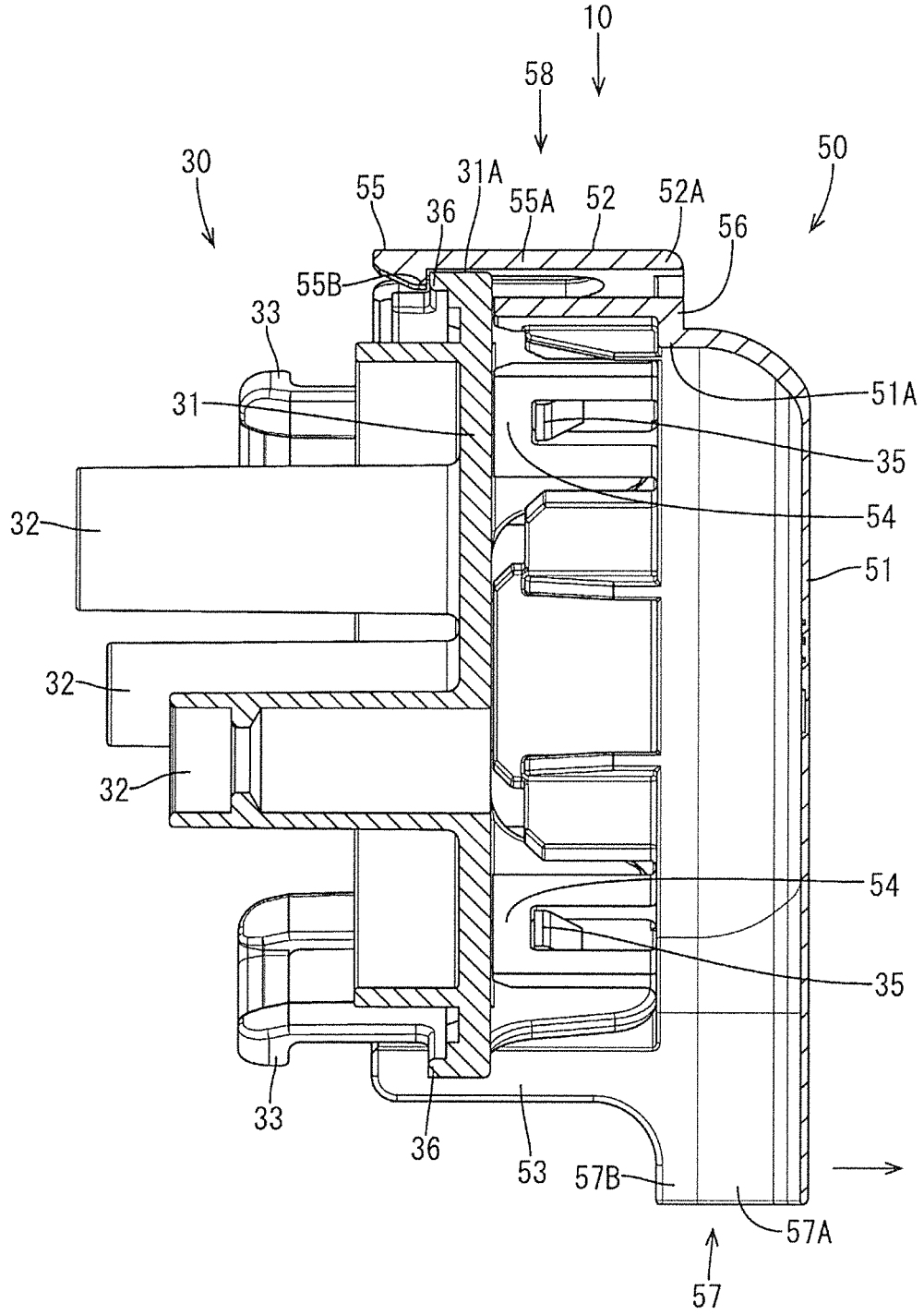
FIG. 4 is a section along C-C in FIG. 1.

As shown in FIGS. 3 and 4, each inner lock 54 includes two locking pieces 54A disposed radially inward of the cover attaching portion 34 and a locked portion 54B to be locked to the locking projection 35A of the inner lock receiving portion 35. The fitting tube 52 is radially outward of an opening edge part 51A of the cover body 51 for covering the base plate 31 from behind. The opening edge 51A of the cover body 51 and a rear end 52A of the fitting tube 52 are coupled to each other by a ring-shaped coupling wall 56. The locking pieces 54A are cantilevered forward from this coupling wall 56 while be arranged in parallel, and front end parts of the locking pieces 54A are coupled by the locked portion 54B.

The locking pieces 54A are deflected radially inward by the locked portions 54B riding on the locking projections 35A of the inner lock receiving portions 35 when the cover 50 is attached to the retainer 30 from behind. When the cover 50 reaches the proper attaching position with respect to the retainer 30, the locking pieces 54A resiliently return and contact the inner lock receiving portions 35 from an inner peripheral side. In this way, the locking projection 35A of each inner lock receiving portion 35 is fit between the locking pieces 54A, and the locked portion 54B is locked to the locking projection 35A from the front to hold the cover 50 on the retainer 30.

As shown in FIG. 4, an opening 57 is provided in a lower part of the cover 50 and extends down from the cover body 51 to open forward and downward. This opening 57 projects farther down than the fitting tube 52 and includes a lower opening 57A that opens down and a front opening 57B that opens forward. Further, the cutout 53 is provided in the lower part of the fitting tube 52. The lower opening 57A, the front opening 57B and the cutout 53 located in the lower end part of the fitting tube 52 constitute one continuous wire introducing groove. By the presence of this wire introducing groove, the wires need not be passed through the cover 50 in advance and the cover 50 can be attached to the retainer 30 from behind later. Note that a part of the cover 50 facing the opening 57 (i.e. an upper end part of the cover 50) is referred to below as a facing portion 58.

The wires pulled out rearward from the respective terminal holding portions 32 of the retainer 30 are bent down in the cover body 51 and drawn out downward through the opening 57. If the wires are pulled rearward, the opening 57 is pulled rearward together with the wires. Then, the entire cover body 50 may incline forward, the inner lock portion 54 disposed on the facing portion 58 may disengage from the inner lock receiving portion 35 to release a locked state, and the facing portion 58 of the cover 50 may separate from the retainer 30. This phenomenon occurs not only when the opening 57 of the cover 50 is pulled rearward. If any part of a peripheral edge of the cover 50 is pulled rearward, the inner lock 54 also is more likely to disengage from the inner lock receiving portion 35 in a part facing the pulled part.

Accordingly, the outer locks 55 are provided in this embodiment to prevent the disengagement of the inner locks 54 from the inner lock receiving portions 35. As shown in FIG. 1, a total of three outer locks 55 are provided on upper, left and right end parts of the fitting tube 52. The respective outer locks 55 are disposed at equal intervals of 90° about an axis line of the cover 50. Specifically, as shown in FIGS. 2 and 4, the outer lock 55 includes an arcuate holding piece 55A constituting the outer peripheral surface of the fitting tube 52 and a holding projection 55 projecting radially in from the front edge of this holding piece 55A. On the other hand, outer lock receiving portions 36 to be locked by the holding projections 55B of the outer lock portions 55 are provided on a periphery of the base plate 31 of the retainer 30. These outer lock receiving portions 36 project forward from the periphery of the base plate 31.

The holding pieces 55A are deflected radially out by the holding projections 55B riding on the outer peripheral surface 31A of the base plate 31 when the cover 50 is attached to the retainer 30 from behind. When the cover 50 reaches the proper attaching position with respect to the retainer 30, the holding pieces 55A resiliently return, thereby contacting the outer peripheral surface 31A of the base plate 31 from an outer peripheral side. Simultaneously with this, the holding pieces 55B lock the outer lock receiving portions 36 from the front to hold the cover 50 on the retainer 30. As just described, with the cover 50 attached in a proper attaching posture to the retainer 30, the outer locks 55 are in contact with the outer lock receiving portions 36 from the outer peripheral side to lock the outer lock receiving portions 36 in a separating direction of the cover 50, and the inner locks 54 are in contact with the inner lock receiving portions 35 from the inner peripheral side to lock the inner lock receiving portions 54 in the separating direction of the cover 50, thereby holding the cover 50 on the retainer 30.

Accordingly, if a force as to separate the inner lock portion 54 from the inner lock receiving portion 35 acts, the outer lock 55 disposed adjacent to this inner lock 54 acts to approach the outer lock receiving portion 36. Thus, the locked state of the outer lock 55 and the outer lock receiving portion 36 is maintained. On the other hand, if a force as to separate the outer lock 55 from the outer lock receiving portion 36 acts, the inner lock 54 disposed adjacent to this outer lock portion 55 acts to approach the inner lock receiving portion 35. Thus, the locked state of the inner lock 54 and the inner lock receiving portion 35 is maintained. As just described, even if one of the locks does not function, the other lock portion functions. Thus, a holding force for the cover 50 is maintained regardless of the direction in which a force acts.

For example, if the wires drawn out downward from the opening 57 are pulled rearward in FIG. 4, the opening 57 of the cover 50 is pulled in a direction of an arrow, as shown. In this case, the inner lock 54 is going to be disengaged from the inner lock receiving portion 35 on the facing portion 58 (upper end part of the cover 50 in FIG. 4) facing the opening 57 of the cover 50, but the separation of the facing portion 58 of the cover 50 can be prevented since the outer lock 55 is held locked to the outer lock receiving portion 36.

As described above, in this embodiment, even if the inner lock 54 moves in a direction away from the inner lock receiving portion 35 to release the locked state when the opening 57 of the cover 50 is pulled rearward, the outer lock 55 conversely approaches the outer lock receiving portion 36 to maintain the locked state. Thus, the facing portion 58 of the cover 50 is not separated from the housing (retainer 30). Further, even if the outer lock 55 moves in a direction away from the outer lock receiving portion 36 to release the locked state when the opening 57 of the cover 50 is pushed forward, the inner lock portion 54 conversely approaches the inner lock receiving portion 35 to maintain the locked state. Thus, the facing portion 58 of the cover 50 is not separated from the housing.

The cover 50 includes the fitting tube 52 configured into a tubular shape by alternately disposing the outer locks 55 and the inner locks 54 side by side. According to this configuration, the fitting tube 52 can be reduced in size as compared to the case where the outer locks 55 and the inner locks 54 are disposed in an overlapping manner.

The outer lock portions 55 may be disposed at equal intervals over the entire circumference of the fitting tube 52. According to this configuration, the locked state is maintained even if the cover 50 is pulled in any direction, and the cover 50 is not separated from the housing.

OTHER EMBODIMENTS

The invention is not limited to the above described and illustrated embodiment. For example, the following various modes also are included.

Although the cover 50 is attached to the inlet body via the retainer 30 in the above embodiment, the cover 50 may be directly attached to the inlet body. That is, the retainer 30 is an example of the housing.

The outer locks 55 and the inner locks 54 are disposed alternately disposed side by side in the circumferential direction in the above embodiment. However, outer and inner locks may be arranged radially side by side and the cover attaching portions 34 may be inserted between the outer locks 55 and the inner locks 54.

The outer lock portions 55 are disposed over the entire circumference of the fitting tube 52 in the above embodiment. However, the outer lock 55 and the inner lock 54 may be provided only on the facing portion 58.

LIST OF REFERENCE SIGNS

10 . . . connector
30 . . . retainer (housing)
35 . . . inner lock receiving portion
36 . . . outer lock receiving portion
50 . . . cover
52 . . . fitting tube
54 . . . inner lock
55 . . . outer lock
57 . . . opening
58 . . . facing portion

The invention claimed is:

1. An electrical connector, comprising:

a housing with opposite front and rear ends; and a cover to be attached over the rear end of the housing in an attaching direction;

wherein:

the cover includes a cover body extending in a direction intersecting the attaching direction to the housing and configured to cover the housing, and a fitting tube connecting to the cover body and projecting farther in the attaching direction than the cover body, the fitting tube having a front opening that is open in the attaching direction and that is configured to enable the fitting tube to be fit to the housing, the fitting tube including cutouts continuous with the front opening and open in a direction intersecting the attaching direction, the cutouts forming circumferentially spaced outer locks and inner locks adjacent to one another; and the housing includes outer lock receiving portions and inner lock receiving portions, wherein the outer locks of the fitting tube engage forward facing surfaces of the outer lock receiving portions from an outer peripheral side for preventing movement of the cover in a separating direction that is opposite the attaching direction, and the inner locks of the fitting tube engage forward facing surfaces of the inner lock receiving portions from an inner peripheral side for preventing movement in the separating direction of the cover.

2. The connector of claim 1, wherein the outer locks are disposed at equal intervals over an entire circumference of the fitting tube.

3. The connector of claim 2, wherein the inner locks are disposed at equal intervals over the entire circumference of the fitting tube.

4. The connector of claim 1, wherein the outer locks are at positions spaced radially outward from position of the inner locks.

5. An electrical connector, comprising:

a housing having a base plate with an outer peripheral surface, at least one cover attaching portion projecting rearward from the peripheral edge of the base plate, an inner peripheral surface of the at least one cover attaching portion defining an inner lock receiving portion with locking projections projecting radially inward, and at least one outer lock receiving portion projecting forward from the base plate; and a cover to be attached to the housing, the cover includes a cover body extending in a direction intersecting an attaching direction to the housing and configured to cover the housing and a front opening open in the attaching direction, and a fitting tube having cutouts and projecting from the cover body in the attaching direction and to be fit to the housing, at least one of the cutouts continuous with the front opening and open in a direction intersecting the attaching direction, a facing portion facing the cutout, an outer lock provided at least on the facing portion and an inner lock provided on the fitting tube adjacent to the outer lock, wherein the outer lock is opposed to an outer peripheral surface of the fitting tube and is locked to the outer lock receiving portion in a separating direction of the cover that is opposite the attaching direction and the inner lock is opposed to an inner peripheral surface of the fitting tube and is locked to the inner lock receiving portion in the separating direction.

* * * * *